United States Patent [19]

Gordon

[11] Patent Number: 4,463,540

[45] Date of Patent: Aug. 7, 1984

[54] EXTRUSION FOR INSULATED BUILDING CONSTRUCTIONS

[75] Inventor: Alfred J. Gordon, Mosinee, Wis.

[73] Assignee: Alexander J. Gordon, Farmington Hills, Mich.

[21] Appl. No.: 301,700

[22] Filed: Sep. 14, 1981

[51] Int. Cl.[3] ..... E04C 3/30

[52] U.S. Cl. ..... 52/730; 52/403; 52/734; 49/DIG. 1; 29/416

[58] Field of Search ..... 52/403, 734, 309.16, 52/309.7, 404, 730; 49/DIG. 1; 29/155 R, 416, 418; 72/254; 264/46.7, 267, 269

[56] References Cited

U.S. PATENT DOCUMENTS

| | | | |
|---|---|---|---|
| 896,589 | 8/1908 | Schlafly | 52/734 |
| 3,093,217 | 6/1963 | Doede . | |
| 3,204,324 | 9/1965 | Nilsen . | |
| 3,287,772 | 11/1966 | Steinhauser | 52/734 |
| 3,332,170 | 7/1967 | Bangs | 49/DIG. 1 |
| 3,445,974 | 5/1969 | Bragman | 49/DIG. 1 |
| 3,823,524 | 7/1974 | Weinstein | 49/DIG. 1 |
| 3,978.629 | 9/1976 | Echols, Sr. | 52/730 X |
| 4,067,163 | 1/1978 | Hetman | 49/DIG. 1 |
| 4,084,029 | 4/1978 | Johnson et al. | 52/734 |

FOREIGN PATENT DOCUMENTS

| | | | |
|---|---|---|---|
| 2080378 | 2/1982 | United Kingdom | 52/404 |

*Primary Examiner*—Carl D. Friedman
*Attorney, Agent, or Firm*—Krass & Young

[57] ABSTRACT

An improved extrusion design is disclosed for use in constructing insulated windows, curtain walls and the like which incorporate a thermal barrier insulator between inner and outer portions of their structure. The extrusion includes a channel defined by mutually opposing surfaces of the inner and the outer portions together with a temporary bridging section which is later removed after the channel is filled with the thermal barrier insulator. The extrusion includes a reinforcing section which is connected solely to the bridging section and extends transversely across the channel. The channel may be filled with the insulating material such that it surrounds the reinforcing section and is mechanically interlocked therewith to increase its strength. When the bridging section is removed, the reinforcing section is completely isolated from the inner and outer portions of the extrusion so as not to degrade the thermal insulating properties of the structure.

3 Claims, 4 Drawing Figures

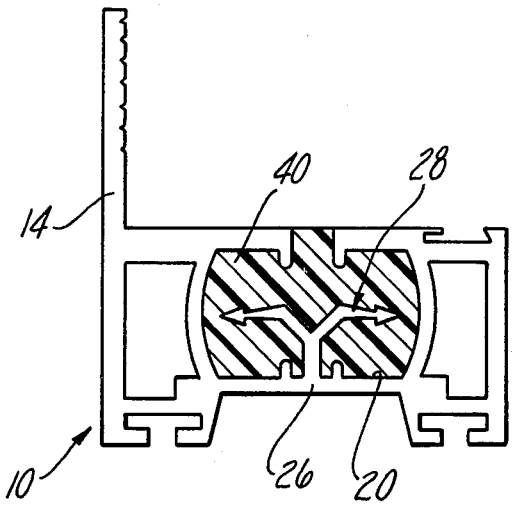
Fig-3
Fig-4
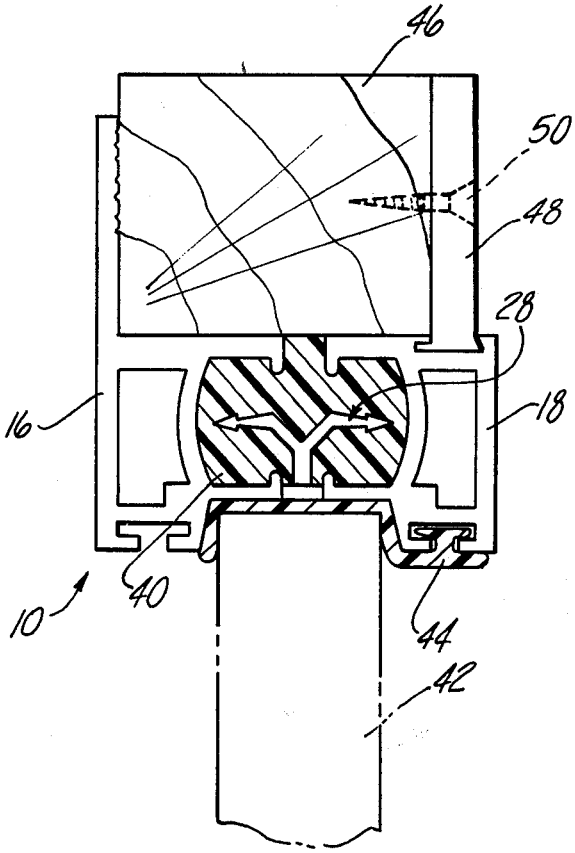

EXTRUSION FOR INSULATED BUILDING CONSTRUCTIONS

DESCRIPTION

1. Technical Field

This invention relates to building constructions and, more particularly, to metal extrusions for constructing insulated windows, curtain walls and the like.

2. Background Art

The use of metal in constructing windows, curtain walls and the like has become increasingly popular due to the increased strength and weather-resistant characteristics of metal as compared with other construction materials such as wood. However, one of the drawbacks with the use of these metal structures is that they exhibit relatively high thermal conductivities. Accordingly, there is a tendancy for the metal to transfer the temperature of the outside environment into the interior of the building. This, of course, is undesirable especially in relatively hot or cold climates.

In an effort to combat this undesirable thermal transfer problem the prior art has developed so-called thermal barrier or insulated metal structures. Examples of these techniques are disclosed in U.S. Pat. No. 3,093,217 to Doede and U.S. Pat. No. 3,204,324 to Nilsen.

In one commonly used approach a metal extrusion is provided with a channel formed between the inner and outer portions of the structure. The channel is generally defined by opposing concave surfaces in the inner and outer portions of the extrusion together with a bridging section forming the bottom of the channel. A thermal barrier insulating material is poured into the channel and allowed to cure. The bridging section of the extrusion is then removed to break the metal continuity between the inner and outer portions.

While this technique has generally provided acceptable thermal insulation, it, too, has its drawbacks. After the bridging section of the extrusion is removed, the only thing holding the inner and outer portions together is the insulating material. In some building constructions the outer portion of the extrusion may not be connected to any adjacent support structure. Consequently, if the adhesion between the metal portions and the insulating material fails or if the insulating material develops cracks therein, it is possible for the outer portion of the extrusion to come loose or even fall. To overcome this problem the prior art concentrated on improving the adhesive or structural properties of the insulating material but these attempts have not been entirely satisfactory.

DISCLOSURE OF THE INVENTION

In accordance with the present invention a metal structure is provided with an additional reinforcing section which extends transversely across the channel between the spaced inner and outer portions thereof. The reinforcing section is connected soley to the bridging section of the structure and is otherwise spaced from the remaining metal portions. When the insulating material fills the channel it surrounds the reinforcing section which provides increased mechanical strength for the insulator. In the preferred embodiment, the reinforcing section is generally T-shaped with the ends of the arms being shaped in a reentrant-type configuration to provide transverse interlocks for the insulator. In the longitudinal direction the reinforcing section may be provided with a non-linear design to provide lengthwise interlocks to prevent the insulator from sliding. When the bridging section is conventionally removed the reinforcing section is automatically thermally isolated from the inner and outer portions of the structure to destroy thermal conductivity therebetween.

BRIEF DESCRIPTION OF THE DRAWINGS

The various advantages of the present invention will become apparent to one skilled in the art upon reading the following specification and by reference to the drawings in which:

FIG. 3 is an end view of the extrusion which further includes the insulating material in the channel; and FIG. 4 is an end view showing the extrusion of the preferred embodiment in typical use after the bridging section has been removed.

DESCRIPTION OF THE PREFERRED EMBODIMENT

Figure 1:
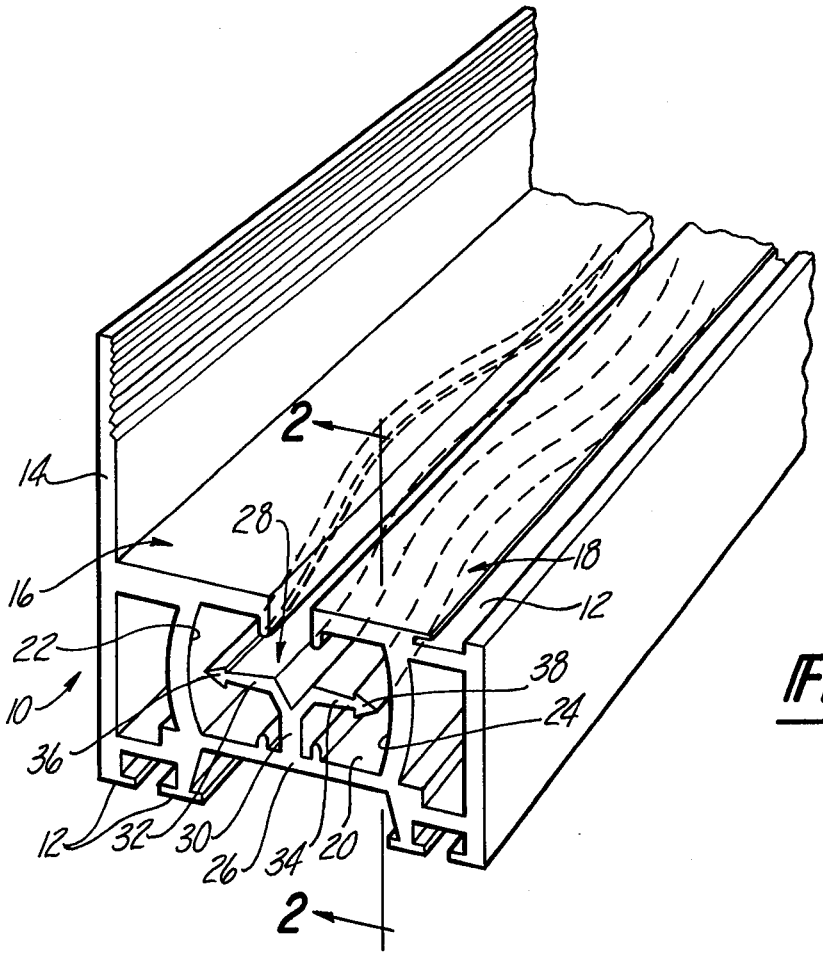
FIG. 1 is a perspective view of an extrusion incorporating the preferred embodiment of the invention.

The preferred embodiment of the invention is incorporated as part of an aluminum metal extrusion 10 shown in FIG. 1. Those skilled in the art will appreciate that the exact configuration of extrusion 10 will vary considerably depending upon the type of installation in which it is to be used. Extrusions, like extrusion 10 are typically used for frames or sashes in insulated windows, curtain walls and the like. Consequently, the location and configuration of the male and female interlocks (generally designated by the numeral 12) as well as the shape of the outer extremities (such as flange 14) are a matter of design choice. In general, these extrusions include an outer portion 16 and an inner portion 18 which are elongated members running longitudinally parallel with each other. A longitudinally extending channel 20 is formed in extrusion 10 between outer portion 16 and inner portion 18. The sides of channel 20 are defined by mutually opposing C-shaped surfaces 22 and 24 in outer portion 16 and inner portion 18, respectively. The bottom of the channel 20 is defined by a bridging section 26 which joins the lower portions of surfaces 22 and 24 together.

Pursuant to this invention a reinforcing section (generally designated by the numeral 28) is provided within the confines of channel 20 and is an integral part of extrusion 10. In the preferred embodiment, reinforcing section 28 is generally T-shaped having a leg portion 30 connected normally to bridging section 26. The opposing arms 32 and 34 extend from leg 30 at about a 45° angle for a short distance and then bend generally diametrically opposite to one another. Arms 32 and 34 terminate with generally arrowhead-shaped ends 36 and 38, respectively, to provide a re-entrant configuration.

Reinforcing section 28 extends transversely substantially the entire width across channel 20. However, it is important to note that the ends 36 and 38 are spaced from their respective surfaces 22 and 24 of extrusion 10. The only connection to extrusion 10 is by way of leg portion 30 which is connected to the bridging section 26. The width of the arm extensions of reinforcing section 28 may vary but preferably ends 36 and 38 extend beyond the vertically extending projections of the C-shaped surfaces 22 and 24.

Figure 2:
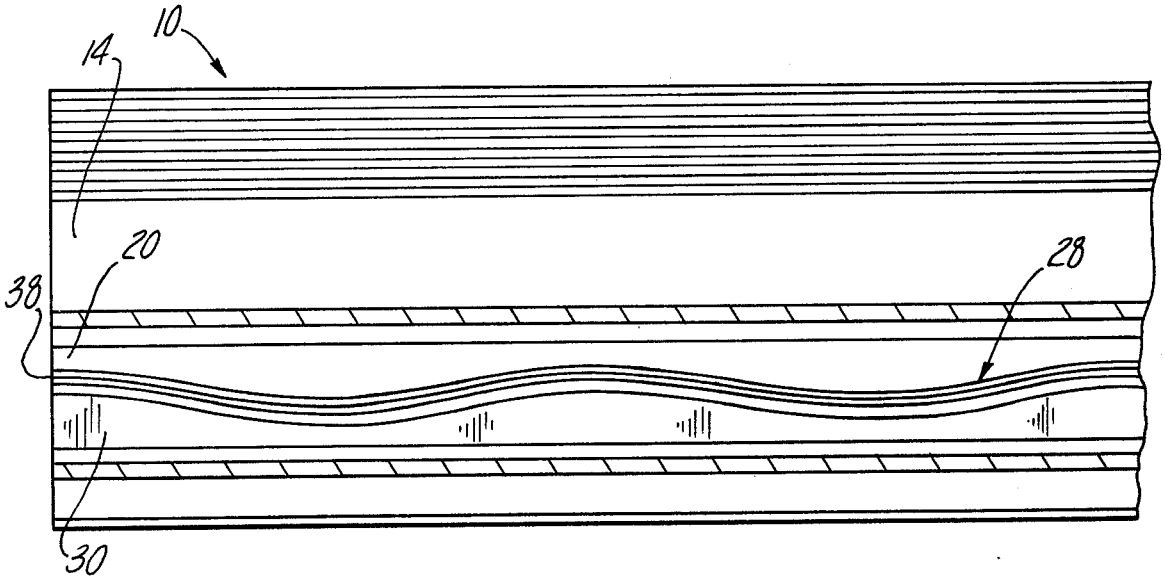
FIG. 2 is a longitudinal cross sectional view along the lines 2—2 of FIG. 1.

In the preferred embodiment the reinforcing section 28 may take the form of a waved or non-linear configuration in the longitudinal direction as can be seen in FIG. 2. This variable configuration may be accomplished by a technique known in the art as rippling by filing the die bearings in an appropriate manner so that a wavy section will eminate from the filed die bearings in the longitudinal direction. This is an optional feature of this invention and is not critical to the broader concepts disclosed herein.

In typical use the channel 20 is filled with a thermal insulating material 40 as can be seen in FIG. 3. A variety of thermal insulating materials can be used. For example, liquid polyurethane may be poured into the channel 20 and allowed to cure to form a rigid body. As can be seen in FIG. 3, insulating material 40 completely fills channel 20 and surrounds reinforcing section 28.

After the insulating material 40 has hardened, the bridging section 26 is removed as shown in FIG. 4. Typically, bridging section 26 is removed by cutting or sawing using a router head or horizontal mill-type cutter. The removal of bridging section 26 simultaneously serves to isolate reinforcing section 28 from remaining portions of the metal extrusion 10. This is important because otherwise there would be a thermally conductive path between the inner and outer portions of the extrusion. However, since reinforcing section 28 is only connected to the bridging section 26 it is completely isolated from the surrounding metal parts when the bridging section is removed.

FIG. 4 shows extrusion 10 in a typical installation which is somewhat simplified in the drawings. Extrusion 10 is illustrated as part of a frame for a window 42 which is connected to the lower portion of extrusion 10 by way of seal 44. The upper portion of extrusion 10 is connected to a support structure such as a stud or other structural member 46 by way of a bracket 48 through which an attachment screw 50 is provided. Various other hardware configurations and modifications should be evident to one skilled in the art.

It can now be appreciated that the outer portion 16 of extrusion 10 is completely thermally isolated from the inner portion 18. Moreover, the reinforcing section 28 provides excellent mechanical strength for insulator 40. The re-entrant-shaped ends 36 and 38 provide interlocks which resist lateral separation of the inner and outer portions even if a crack should somehow develop vertically through insulator 40. The non-linear nature of reinforcing section 28 in the longitudinal direction prevents lengthwise sliding of the insulator 40.

Thus, it is apparent that the present invention provides a substantial improvement to insulated windows, curtain walls and the like. The increased strength is accomplished with very little additional cost in making the extrusion and with no additional steps required in fabricating the ultimate installation. Still other modifications and advantages will become apparent to one skilled in the art upon a study of the specification, drawings and claims.

What I claim is:

1. Apparatus for constructing insulated windows, curtain walls and the like, said apparatus comprising:

first and second elongated metal sections having spaced opposing surfaces joined by a plug of insulating material, and a generally T-shaped reinforcing section made of the same material as the first and second sections, said reinforcing section having arm portions extending substantially across and being substantially surrounded by the insulator plug while being spaced from the opposing surfaces of the first and second sections, with the reinforcing section having a leg portion extending to the periphery of the plug in a space between the first and second sections previously occupied by a bridging section therebetween.

2. A method of making apparatus for constructing insulated windows, curtain walls and the like, said method comprising:

providing a metal structure having first and second portions with mutually opposing surfaces and a bridging section defining a channel therebetween, said structure further including a reinforcing section connected solely to said bridging section and extending into the channel;

filling the channel with insulating material so as to substantially surround said reinforcing section; and removing said bridging section while leaving said reinforcing section remaining in said insulator material.

3. The method of claim 2 wherein said metal structure is provided by extruding aluminum.

* * * * *